US006070421A

United States Patent [19]

Petrovich et al.

[11] Patent Number: 6,070,421

[45] Date of Patent: Jun. 6, 2000

[54] 5 OR 8 KW REFRIGERATING SYSTEM AND CENTRIFUGAL COMPRESSOR ASSEMBLY FOR SAID SYSTEM

[75] Inventors: Verechtchagin Mikhail Petrovich; Verechtchagin Maxim Mikhailovich; Kolontchine Victor Semenovich, all of Moscow, Russian Federation

[73] Assignee: Samjin Co., Ltd., Kyunggi-do, Rep. of Korea

[21] Appl. No.: 09/142,641

[22] PCT Filed: Apr. 26, 1996

[86] PCT No.: PCT/RU96/00095

§ 371 Date: Sep. 11, 1998

§ 102(e) Date: Sep. 11, 1998

[87] PCT Pub. No.: WO97/39292

PCT Pub. Date: Oct. 23, 1997

[30] Foreign Application Priority Data

Apr. 18, 1996 [RU] Russian Federation ..... 96107044

[51] Int. Cl.[7] ..... F25B 1/10; F25B 31/00

[52] U.S. Cl. ..... 62/210; 62/505; 62/510

[58] Field of Search ..... 62/210, 510, 505

[56] References Cited

U.S. PATENT DOCUMENTS 5,211,031 5/1993 Murayama et al. ..... 62/510 X 5,253,489 10/1993 Yoshii ..... 62/505

5,655,379 8/1997 Jaster et al. ..... 62/510

*Primary Examiner*—William Wayner

*Attorney, Agent, or Firm*—Brown Raysman Millstein Felder & Steiner LLP

[57] ABSTRACT

A refrigerating system has a condenser, an evaporator, and a two-stage centrifugal compressor assembly with an electric motor provided with a cooling system. A condenser inlet is connected to a compressor assembly outlet, while a condenser outlet is connected via first and second choke elements to an inlet of the evaporator and to the cooling system. The evaporator outlet communicates with the compressor assembly inlet, and the cooling system outlet communicates with the inlet of the second stage of the assembly. The cooling system is provide with a cooling skirt having a cavity of the cooling system lying between a stator and a housing. The refrigerating system has a separator vessel, a recuperative heat exchanger, and a heat-regulating valve controlled by the coolant pressure and temperature at the cooling skirt inlet, and also fitted in series with the separator vessel in the line connecting the condenser inlet to the evaporator. The separator vessel is connected by a gas phase to the coolant feed duct. The heat exchanger is connected by the coolant to a line connecting the condenser outlet to the evaporator inlet via the separator vessel. The second choke element is a heat-controlled valve regulated by the pressure and temperature of the coolant in the coolant discharge line from the cooling skirt.

6 Claims, 2 Drawing Sheets

5 OR 8 KW REFRIGERATING SYSTEM AND CENTRIFUGAL COMPRESSOR ASSEMBLY FOR SAID SYSTEM

AREA OF TECHNOLOGY

The utility model pertains to heat and power engineering and can be used in refrigeration technology.

PRIOR ART

There is a known refrigerating system comprising a condenser, an evaporator, and a two-stage centrifugal compressor assembly with a built-in electrical motor between the stages. The motor is provided with a cooling system that has coolant feed and discharge ducts connected to the internal cavity of its housing. Further, the condenser inlet is connected to the compressor assembly outlet, and the condenser outlet is connected by one line to the evaporator inlet via the first choke element, and by a second line to the electrical motor cooling system via the second choke element. The evaporator outlet communicates with the compressor assembly inlet, and the gas coolant discharge duct is connected to the outlet of the compressor assembly's second stage (1).

The drawbacks of this known cooling system are low efficiency and reliability due to the fact that wet vapor can enter the exhaust of the compressor's first stage; the presence of oil in the system; the narrow range of controllability; and the fact that ecologically safe coolants cannot be used.

There is a known centrifugal compressor assembly for a refrigerating system comprising two centrifugal compressor stages with rotors, diffuser ducts, collection chambers, inlet and outlet tubing for the second stage, and a built-in electrical motor between the compressor assembly's first and second stages. The rotor of the electrical motor is positioned with the centrifugal stage rotors on one shaft, which is mounted on bearings, and the stator is fixed inside its housing, forming a cooling skirt between them. Further, the motor housing is provided with gas coolant feed and discharge ducts which are connected to the outlet tubing of the compressor assembly's second stage (1).

The drawbacks of this known centrifugal compressor assembly for a cooling system are low reliability due to the unsatisfactory design of the electrical motor's cooling system; the lack of total compensation for axial forces on the assembly's shaft; the large size of the electrical motor; and the fact that basic design solutions cannot be used for small assemblies, such as those with 5 and 8 kW cooling capacities.

SUMMARY OF THE INVENTION

For the refrigerating system, this utility model is intended to increase efficiency and reliability while ensuring ecological safety by allowing the use of ecologically safe coolants; it also broadens the range of cooling capacities and control.

For the centrifugal compressor assembly of said system, this utility model is intended to increase reliability, reduce dimensions and broaden the range of use.

The 5 or 8 kW refrigerating system in this claim comprises a condenser, an evaporator, and a two-stage centrifugal compressor assembly provided with a built-in electrical motor between the compressor stages. The motor has a cooling system with gas coolant feed and discharge ducts which are connected to the motor's internal cavity. Further, the condenser inlet is connected to the compressor assembly's outlet, and the condenser outlet is connected by one line to the evaporator inlet via the first choke element, and by a second line to the motor's cooling system via the second choke element. The evaporator outlet communicates with the compressor assembly's inlet, and the coolant discharge duct is connected to the outlet of the compressor's second stage. We propose fitting the system with an additional choke element, a separator vessel, and a recuperative heat exchanger, and providing the electrical motor's cooling system with a cooling skirt which is insulated from the internal cavity of the motor housing. The cavity of the cooling skirt is located between the stator and the motor housing and is connected to the second coolant feed and discharge ducts. Further, the additional choke element is a heat regulating valve controlled by the coolant pressure and temperature at its inlet, and the separator vessel is mounted in series in the line connecting the condenser outlet to the evaporator, before the first choke element. The separator vessel is connected by the gas phase to the coolant feed duct, and the recuperative heat exchanger is connected by the coolant to the line connecting the evaporator outlet to the condenser inlet, and to the line connecting the condenser outlet to the evaporator inlet, after the separator vessel. Further, the second line from the condenser is connected to the second coolant feed duct, the second coolant discharge duct is connected to the separator vessel, and the additional choke element, located in the second line, is a heat-regulating valve controlled by the temperature and pressure of the coolant in the second coolant discharge duct.

In addition, the first choke element, mounted in the line from the condenser to the evaporator, is a heat-regulating valve controlled by the coolant pressure and temperature at the evaporator outlet.

The refrigerating system is equipped with a device for controlling motor speed according to the temperature of the air leaving the evaporator.

The 5 or 8 kW centrifugal compressor assembly for said refrigerating system in this claim comprises two centrifugal stages with rotors, diffuser valves, collection chambers and inlet and outlet tubing, Further, the first stage outlet tubing is connected to the second stage inlet tubing by a delivery duct. There is a built-in electrical motor between the stages; its rotor is positioned with the compressor stage rotors on one shaft, which is mounted on gasodynamic bearings, and the stator is fixed inside the motor housing, forming a cooling skirt between them. Further, the motor housing is provided with coolant feed and discharge ducts which are connected to the outlet tubing for the compressor assembly's second stage. For this assembly, we propose forming the stator cooling skirt with lengthwise slots on the surface of the stator in contact with the housing, the ends of which are connected to annular grooves on the on the internal surface of the motor housing. Further, each of the annular grooves is connected to the second coolant feed or discharge ducts, and the feed and discharge ducts are connected to the internal cavity of the motor housing from different sides of the stator.

In addition, there are lengthwise slots on the surface of the stator in contact with the rotor.

The shaft of the centrifugal compressor assembly is mounted on radial, gasodynamic bearings.

The centrifugal compressor assembly is equipped with bilateral, gasodynamic axial bearings mounted on a gimbal suspension on the shaft in the internal cavity of the motor housing, between the stator and one of the coolant feed or discharge ducts.

SHORT DESCRIPTION OF DRAWINGS

The drawings illustrate the utility model.

DETAILED DESCRIPTION OF THE PREFERRED EMBODIMENTS

Figure 1:
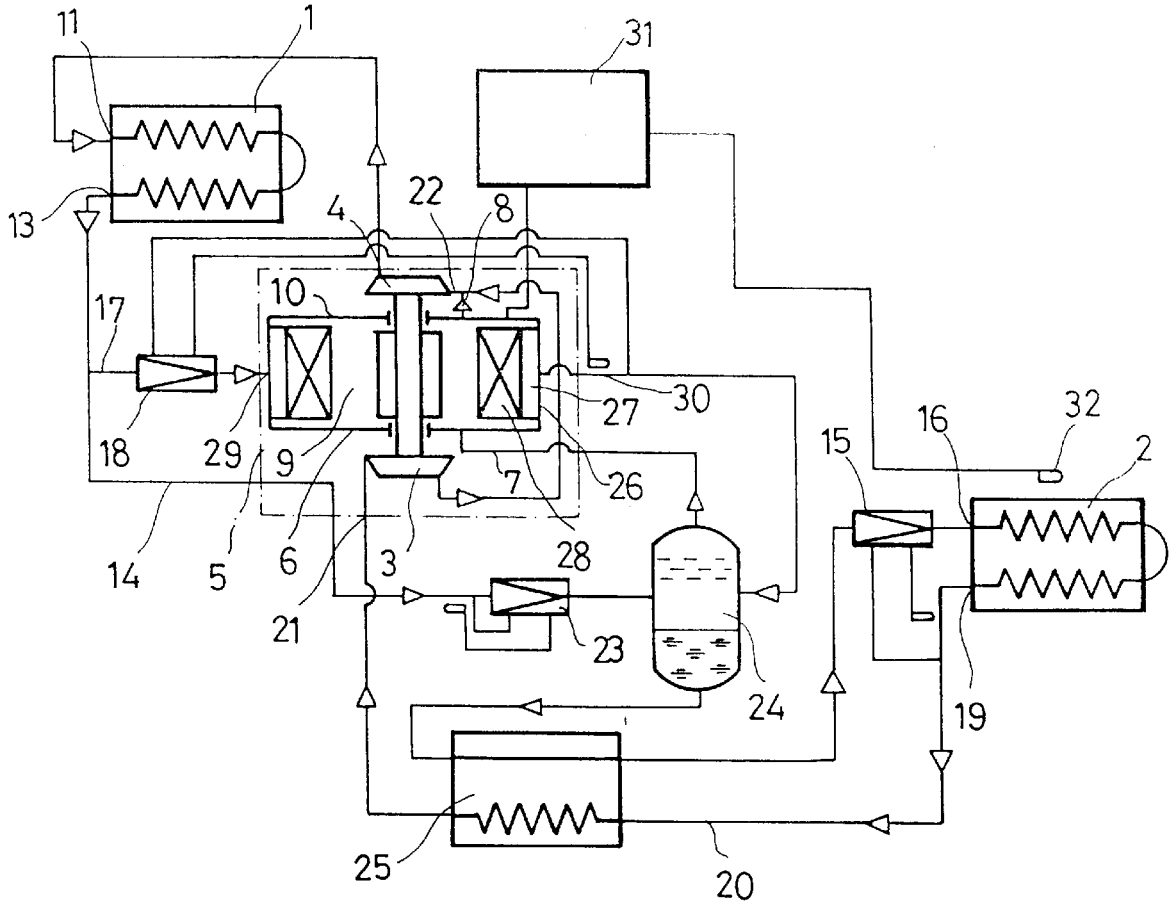
FIG. 1 shows the diagram of the refrigerating system.

The refrigerating system (see FIG. 1) comprises a condenser (1), an evaporator (2), and a two-stage centrifugal compressor assembly provided with a built-in electrical motor (6) between the stages (3 and 4) of the compressor assembly (5). The motor is provided with a cooling system with gas coolant feed and discharge ducts (7 and 8) which are connected to the internal cavity (9) of the motor (6) housing (10). Further, the inlet (11) of the condenser (1) is connected to the outlet (12) of the compressor assembly (5), and the condenser outlet (13) is connected by one line (14) to the inlet (16) of the evaporator (2) via the first choke element (15), and by a second line (17) to the cooling system of the electrical motor (6) via the second choke element (18). The outlet (19) of the evaporator (2) is connected by a line (20) with the inlet (21) of compressor assembly (5), and the gas coolant discharge duct (8) is connected to the inlet (22) of the compressor assembly's (5) second stage (4). Further, the system is equipped with an additional choke element (23), a separator vessel (24), and a recuperative heat exchanger (25), and the cooling system for the electrical motor (6) is provided with a cooling skirt (26) which is insulated from the internal cavity (9) of the motor's (6) housing (10). The cooling skirt cavity (27) is located between the stator (28) and the motor housing (10) and is connected to the second coolant feed and discharge ducts (29 and 30). Further, the additional choke element (23) is a heat regulating valve controlled by the coolant pressure and temperature at its inlet, and the separator vessel (24) is mounted in the line (14) connecting the outlet (13) of the condenser (1) to the evaporator (2), before the first choke element (15). The separator vessel (24) is connected by the gas phase to the coolant feed duct (7), and the recuperative heat exchanger (25) is connected by the coolant to the line (20) connecting the condenser outlet (19) to inlet (21) of the compressor assembly (5), and to the line (14) connecting the outlet (13) of the condenser (1) to the inlet (16) of the evaporator (2), after the separator vessel (24). Further, the second line (17) from the condenser (1) is connected to the second coolant feed duct (29) of the cooling skirt (26), the second coolant discharge duct (30) is connected to the separator vessel (24), and the second choke element (18), located in the second line (17), is a heat-regulating valve controlled by the temperature and pressure of the coolant in the second coolant discharge duct (30).

The first choke element (15), mounted in the line from the condenser (1) to the evaporator (2), is a heat-regulating valve controlled by the coolant pressure and temperature at the outlet (19) of the evaporator (2).

The refrigerating system is equipped with a device (31) for controlling the speed of the motor (6) according to the temperature of the air leaving the evaporator (2), indicated by a signal from a temperature sensor (32).

Figure 2:
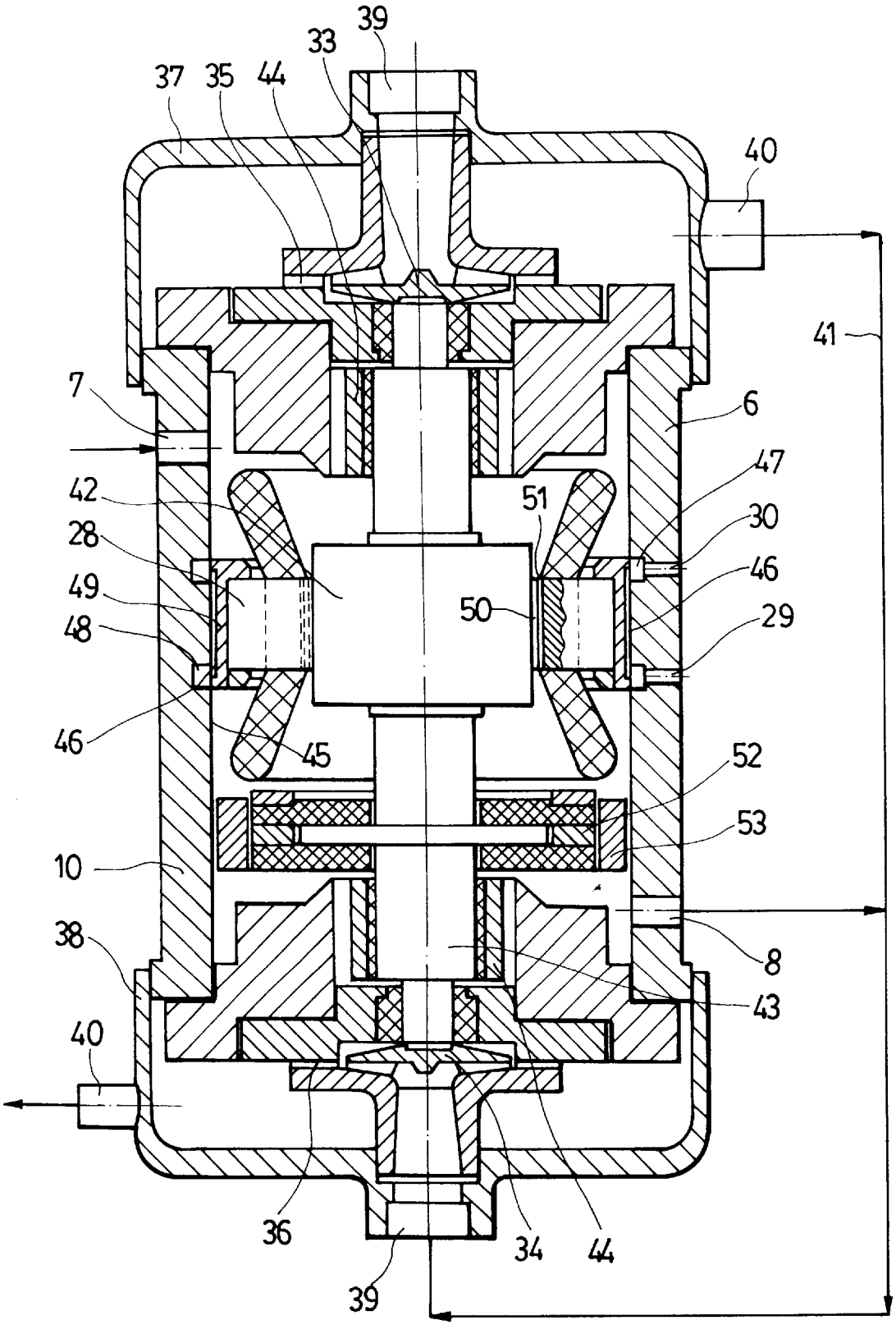
FIG. 2 shows the cross-section of the centrifugal compressor assembly for said system.

The centrifugal compressor assembly for said refrigerating system comprises (see FIG. 2) two centrifugal compressor stages (3 and 4) with rotors (33 and 34), diffuser ducts (35 and 36), collection chambers (37 and 38) and inlet and outlet tubing (39 and 40). Further, the tubing (40) for the outlet of the first stage (3) is connected by a delivery duct (41) to the inlet tubing (39) for the second stage (4). There is a built-in electrical motor (6) between the stages (3 and 4) of the compressor assembly (5); the motor's rotor (42) is positioned with the rotors (33 and 34) of the compressor stages (3 and 4) on one shaft (43), which is mounted on gasodynamic bearings (44), and the stator (28) of the motor (6) is fixed inside its housing (10), forming a cooling skirt (26) between them. Further, the housing (10) of the motor (6) is provided with coolant feed (7) and discharge (8) ducts which are connected to the outlet tubing (39) for the second stage (4) of the compressor assembly (5). The cooling skirt (26) for the stator (28) is formed with lengthwise slots (46) on the surface (45) in contact with the housing (10), the ends of which are connected to annular groves (47 and 48) on the internal surface (49) of the motor (6) housing (10). Further, each of the annular grooves (47 and 48) is connected to the second coolant feed or discharge ducts (29 and 30), which are connected to the internal cavity (9) of the motor (6) housing (10) from different sides of the stator (28).

On the surface (50) of the stator (28) in contact with the rotor (42), there are lengthwise slots (51). The shaft (43) is mounted on radial gasodynamic bearings or roller bearings. The centrifugal compressor assembly is equipped with bilateral, gasodynamic axial bearings (52) on a gimbal suspension (53) mounted on the shaft in the internal cavity (9) of the motor (6) housing (10), between the stator (28) and one of the coolant feed (7) or discharge (8) ducts.

Optimum Implementation of Utility Model

The refrigerating system and centrifugal compressor assembly work as follows. The electrical motor (6) is switched on and starts up the centrifugal compressor (5). Coolant vapor is drawn from the evaporator (2) and heated when it passes through the recuperative heat exchanger (25). In the first stage (3) of the centrifugal compressor (5), the coolant vapor is compressed and sent to the inlet (22) of the second stage (4), where it is mixed with coolant vapor from the coolant discharge duct (8) coming from the interior cavity (9) of the motor (6) housing (10).

Coolant vapor enters the internal cavity (9) from the separator vessel (24) through the coolant feed duct (7). As the coolant vapor passes through the gap between the stator (28) and the rotor (42) and travels along the slots (51) on the stator (28) surface (50) to the coolant discharge duct (8), it cools the rotor (42) and stator (28) of the electrical motor (6). After mixing, the coolant vapor is compressed in the second stage (4) of the centrifugal compressor (5) and is then sent from its outlet (12) to the inlet (11) of the condenser (1). In the condenser, the coolant vapor is condensed by drawing off heat with cooling air.

Most of the liquid coolant from the condenser (1) is sent along the line (14) to the separator vessel (24) through the first choke element (23), which is a heat-regulating valve that operates on the principle of super-cooling liquid coolant. Further, the liquid coolant is throttled to intermediate pressure in the separator vessel (24), where the vapor-liquid coolant mixture is hydrodynamically separated into vapor and liquid.

A small portion of the liquid coolant from the condenser (1) is sent along the second line (17) through the second choke element (18) to the second coolant feed duct (29) and then to the cavity (27) of the motor (6) cooling skirt (26), where part of the liquid coolant is evaporated by drawing off heat from the stator (28). Coolant vapor is taken away from the cooling skirt cavity (26) along the second coolant discharge duct (30) and sent to the separator vessel (24).

The liquid coolant from the separator vessel (24) passes through the recuperative heat exchanger (25) and is super-cooled by the coolant vapors coming from the evaporator along the line (20) to the inlet (21) of the first stage (3) of the compressor assembly (5). After the recuperative heat exchanger (25), the liquid coolant is throttled in the first choke element (15) and enters the evaporator (2) inlet (16). In this way, the coolant is circulated through the refrigerating system.

The refrigerating system's cooling capacity is smoothly controlled by changing the number of rotor (42) rotations with a device (31) for controlling the speed according to the signal from a temperature sensor (32).

The device (31) for controlling the speed of the electrical motor's (6) rotor (42) allows gradual acceleration of the rotor (42) to speeds at which the shaft (43) with the motor rotor (42) and compressor rotors (33) detaches from the surface of the radial gasodynamic bearings (44).

Industrial Application

In the proposed centrifugal compressor assembly, effective cooling of the electrical motor's (6) stator (28) by the cooling skirt (26) is achieved by forming the cooling skirt's internal cavity (27) with lengthwise slots (46) on the surface (45) of the stator (28), which ensures a large surface area for cooling the stator, and with annular grooves (47 and 48) on the internal surface (49) of the motor (6) housing (10). One of these grooves is used to distribute the stream of coolant from the second coolant feed duct (29) along the lengthwise slots (46), and the other is used to collect the coolant and deliver it to the second coolant discharge duct (30).

Because the bilateral, gasodynamic axial bearing (52) with the gimbal suspension (53) is mounted on the shaft (43) in the motor (6) housing (10) between the stator (28) and one of the coolant feed or discharge ducts (7,8), it is cooled by the coolant passing through it.

Thanks to the particular features of its layout and to the design of its centrifugal compressor assembly, the proposed refrigerating system can operate with high molecular mass, ozone-friendly coolants such as RC318, R218 and their mixtures.

What is claimed is:

1. A refrigerating system comprising:

condenser;

an evaporator; and a two stage centrifugal compressor assembly with a built-in electrical motor between the compressor stages;

the electrical motor provided with a cooling system with gas coolant feed and discharge ducts connected to the interior cavity of the motor housing;

the condenser inlet connected to the compressor assembly outlet, and the condenser outlet connected by one line to the evaporator inlet via the first choke element;

wherein, by the second line to the motor's cooling system via the second choke element the evaporator outlet communicates with the compressor inlet, and the gas coolant discharge duct is connected to the inlet of the compressor assembly's second stage;

a third choke element, a separator vessel, a recuperative heat exchanger, and wherein the motor's cooling system is provided with a cooling skirt that is insulated from internal cavity of the motor housing, the cavity of which is located between the stator and the housing and is connected to the second coolant feed and discharge ducts;

wherein the third choke element, which is a heat-regulating valve controlled by the coolant temperature and pressure at its inlet, and the separator vessel mounted in series in the line connecting the condenser outlet to the evaporator, before the first choke element;

wherein the separator vessel is connected to the coolant feed duct by the gas phase;

wherein the recuperative heat exchanger is connected by the coolant to the line connecting the evaporator outlet to the compressor inlet and to the line connecting the condenser outlet to the evaporator inlet, after the separator vessel; and wherein the second line from the condenser is connected to the second separator vessel and the third choke element is located in the second line and is a heat-regulating valve controlled by the pressure and temperature of the coolant in the second coolant discharge duct.

2. The refrigerating system as in claim 1, wherein the first choke element installed in the line from the condenser to the evaporator is a heat-regulating valve controlled by the pressure and temperature of the coolant at the evaporator outlet.

3. The refrigerating system as in claim 1, further comprising a device for controlling the speed of the electrical motor's rotor according to the temperature of the air leaving evaporator.

4. The refrigerating system of claim 1, further comprising:

two centrifugal compressor stages having:

at least one rotor;

at least one diffuser duct;

at least one collection chamber;

an inlet tubing; and an outlet tubing, wherein the outlet tubing of the first compressor stage is connected to the inlet tubing of the second compressor stage by a delivery duct; and a built-in electrical motor between the compressor stages, the rotor of which is positioned with the compressor stage rotors on one shaft mounted on gasodynamic bearings, and the stator of which is fixed inside the motor housing, forming the cooling skirt between them, while inside the motor housing there are coolant feed and discharge ducts connected to the compressor assembly's second stage outlet tubing.

5. The refrigerating system as in claim 4, wherein the assembly's shaft is mounted on radial, gasodynamic bearings, forming three self-adjusting sections.

6. The refrigerating system as in claim 4, further comprising:

two-sided, gasodynamic axial bearings on a gimbal suspension mounted on the shaft in the internal cavity of the motor housing, between the stator and one of the coolant feed or discharge ducts.

* * * * *